US005503292A

United States Patent [19]

Cuccharia

[11] Patent Number: 5,503,292

[45] Date of Patent: Apr. 2, 1996

[54] SYSTEM FOR AUTOMATICALLY LINING A TRASH RECEPTACLE

[76] Inventor: Charles Cuccharia, 304 SE. 30th St., Cape Coral, Fla. 33904

[21] Appl. No.: 339,589

[22] Filed: Nov. 14, 1994

[51] Int. Cl.[6] ..... B65D 90/04

[52] U.S. Cl. ..... 220/407; 220/504; 220/908

[58] Field of Search ..... 220/404, 407, 220/908, 501, 23.83, 630, 636

[56] References Cited

U.S. PATENT DOCUMENTS

| | | | |
|---|---|---|---|
| 3,800,503 | 4/1974 | Maki | 220/407 X |
| 4,319,694 | 3/1982 | Nehrbass et al. | 220/407 |
| 4,955,505 | 9/1990 | Battaglia | 220/407 |
| 5,031,793 | 7/1991 | Chen et al. | 220/407 |
| 5,115,935 | 5/1992 | Lemongelli | 220/407 |
| 5,294,017 | 3/1994 | Li | 220/407 |
| 5,301,829 | 4/1994 | Chrisco | 220/521 |

*Primary Examiner*—Allan N. Shoap

*Assistant Examiner*—Stephen Cronin

*Attorney, Agent, or Firm*—William E. Noonan

[57] ABSTRACT

A system is disclosed for automatically lining a trash receptacle. The system includes a trash receptacle having a side wall portion, an open upper end and a floor portion interconnected to the side wall portion at a lower end of the receptacle. The floor portion has a slot formed therein. A holder includes a peripheral wall portion, a bottom portion interconnected to the peripheral wall portion and an opening that receives the lower end of the receptacle. The receptacle and the holder are interengaged such that the floor of the receptacle is spaced above the bottom portion of the holder to define a bag accommodating chamber in the holder. A spindle carries a roll of perforated plastic trash bags. The spindle is rotatably mounted to the holder such that the spindle extends across the holder chamber. The trash bags are pulled sequentially from the roll through the slot and into the receptacle, whereby each bag is temporarily positioned to line the receptacle and then removed from the receptacle to pull a following bag from the roll into the receptacle.

13 Claims, 2 Drawing Sheets

SYSTEM FOR AUTOMATICALLY LINING A TRASH RECEPTACLE

FIELD OF THE INVENTION

This invention relates to an improved system for automatically lining a trash receptacle and, more particularly, to an apparatus having an upper trash receptacle component and a lower holder component for accommodating a roll of perforated trash bags. Each bag is pulled sequentially from the holder through a slot in the receptacle such that the bag is automatically positioned as a liner in the receptacle.

BACKGROUND OF THE INVENTION

Household trash receptacles are typically lined with a plastic bag to facilitate disposal of the trash that is collected and to minimize soiling of the trash container. A number of products are known that incorporate a supply of perforated plastic bag liners in a holder located at or near the bottom of the trash receptacle. Typically, these bags are connected in an end to end fashion along transverse perforations. A leading bag is drawn upwardly into the receptacle and is positioned therein as a liner. After the bag is filled with trash, it is removed by lifting it out of the receptacle. This pulls a trailing bag up into the receptacle. As a result, when the leading bag is separated from the trailing bag and disposed of, the trailing bag is in position in the receptacle to act as a fresh liner.

Although a number of known apparatuses operate in the above manner, these products usually exhibit one or more of a number of problems. Most employ a fairly complex construction that can be difficult to mold or otherwise manufacture. Additionally, it is often annoying to replace a depleted roll or box of plastic bass with a fresh supply because access to the holder is restricted. In a number of conventional products, these difficulties result from the fact that the holder is formed unitarily with the receptacle. In other products of this type, the holder is received by or otherwise incorporated into the receptacle. This invariably complicates manufacture of the device and periodic replenishment of the plastic liners.

SUMMARY OF INVENTION

It is therefore an object of this invention to provide an improved system for automatically lining a trash receptacle, which system employs an improved, simplified construction.

It is a further object of this invention to provide a trash receptacle that is releasably received by and engaged with a separate and distinct bag holder.

It is a further object of this invention to provide a system for automatically lining a trash receptacle, which permits a fresh supply of replacement liners to be quickly and conveniently installed.

It is a further object of this invention to provide a trash receptacle wherein a fresh plastic liner is drawn quickly, conveniently and reliably into the receptacle each time a trash filled liner is removed from the receptacle.

This invention relates to a system for automatically lining a trash receptacle. The system includes a trash receptacle having a side wall portion, an open upper end and a floor portion interconnected to the side wall portion at a lower end of the receptacle. The floor portion has a slot formed therein. There is a holder including a peripheral wall portion, a bottom portion interconnected to the peripheral wall portion and an opening that receives the lower end of the receptacle. There are means for interengaging the receptacle and the holder such that the floor of the receptacle is spaced above the bottom surface of the holder to define a bag accommodating chamber in the holder. Spindle means carry a plurality of perforated plastic bags. There are means for rotatably mounting the spindle means to the holder such that the spindle means extend across the holder chamber. The trash bass are pulled sequentially from the roll through the slot and into the receptacle. As a result, each bag is temporarily positioned in the receptacle to line the receptacle. The bag is then removed from the receptacle to pull a following bag from the roll into the receptacle.

In a preferred embodiment the receptacle and the holder comprise separate and distinct components, each of which has a unitary construction. The side wall portion may include four interconnected side walls and the peripheral wall portion may include four complementary interconnected peripheral walls. The peripheral wall portion may define the opening of the holder. The peripheral wall portion may also include a tapered inner surface for interengaging, the side wall portion of the receptacle.

Preferably, the means for interengaging include a lip element that is disposed between the receptacle and the holder when the receptacle is received in the opening of the holder. The lip element may include a resilient gasket and is preferably attached to the peripheral wall portion of the holder. Specifically, the peripheral wall portion may include an inner surface that carries the lip element.

The means for rotatably mounting may include a pair of rotation holes formed in the peripheral wall portion for rotatably receiving the spindle means. Alternatively, the means for rotatably mounting, may include other varieties of bearings such as a snap lock bearing or the types of bearings used to rotatably mount a roll of toilet tissue. Releasable latch means may be provided for selectively interlocking the receptacle and the holder.

DETAILED DESCRIPTION OF PREFERRED EMBODIMENTS

Other objects, features and advantages will occur from the following, description of preferred embodiments and the accompanying drawings, in which.

Figure 1:
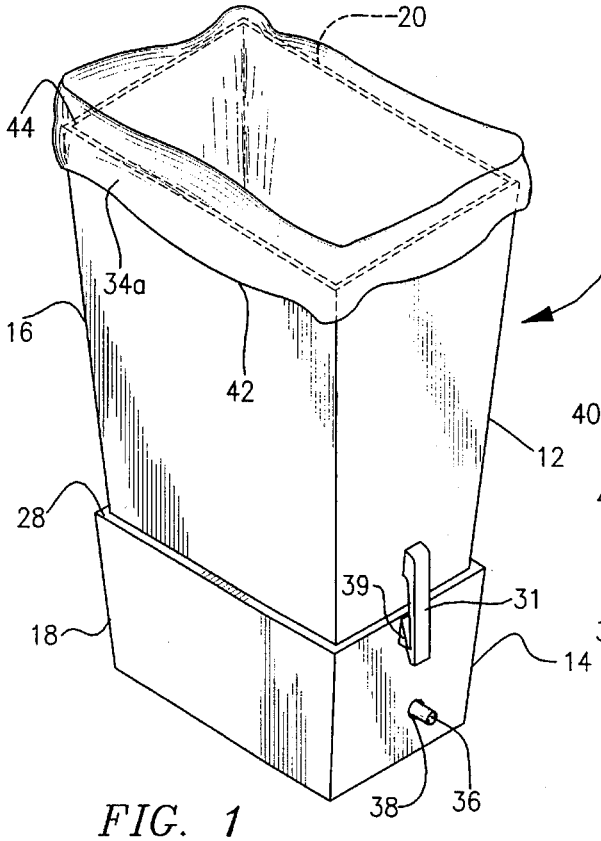
FIG. 1 is a perspective view of a trash receptacle that incorporates the automatic lining system of this invention.

There is shown in FIG. 1 a trash collection apparatus 10 that incorporates the automatic lining system of this invention. Apparatus 10 includes an upper trash receptacle 12 and a lower bag holder 14 that is releasably engaged with receptacle 12. Receptacle 12 includes a side wall portion 16 comprising specifically four generally vertical side walls interconnected unitarily at right angles. Holder 14 includes a complementan/peripheral wall portion 18 likewise having four vertical side walls interconnected unitarily at perpendicular angles. In alternative embodiments, various other side and peripheral wall configurations may be employed, although four walls is a preferred construction. Preferably receptacle 12 and holder 14 employ respective, one-piece molded plastic constructions.

Figure 2:
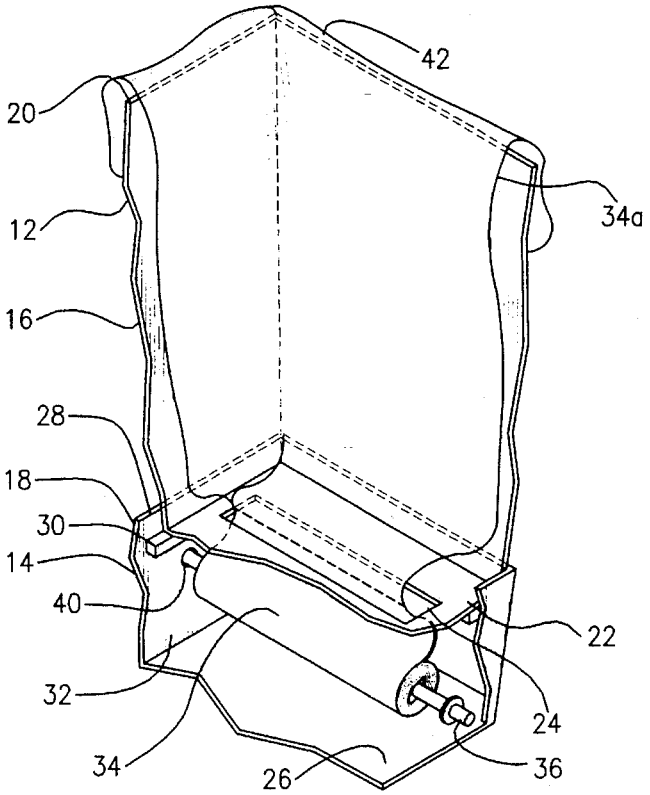
FIG. 2 is a perspective, cut away view of the automatic trash receptacle lining system.

As illustrated in FIGS. 1 and 2, receptacle 12 includes a conventional open upper end 20. A floor portion 22, shown specifically in FIG. 2, is connected unitarily to the lower end of side wall portion 16. An elongate slot 24 is formed in floor portion 22.

Figure 3:
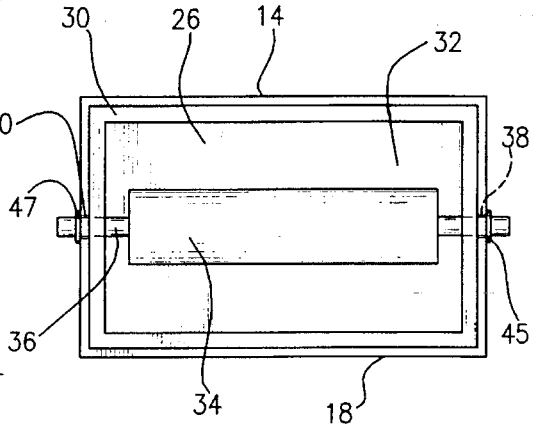
FIG. 3 is a cross sectional view of the trash receptacle lining system.
Figure 4:
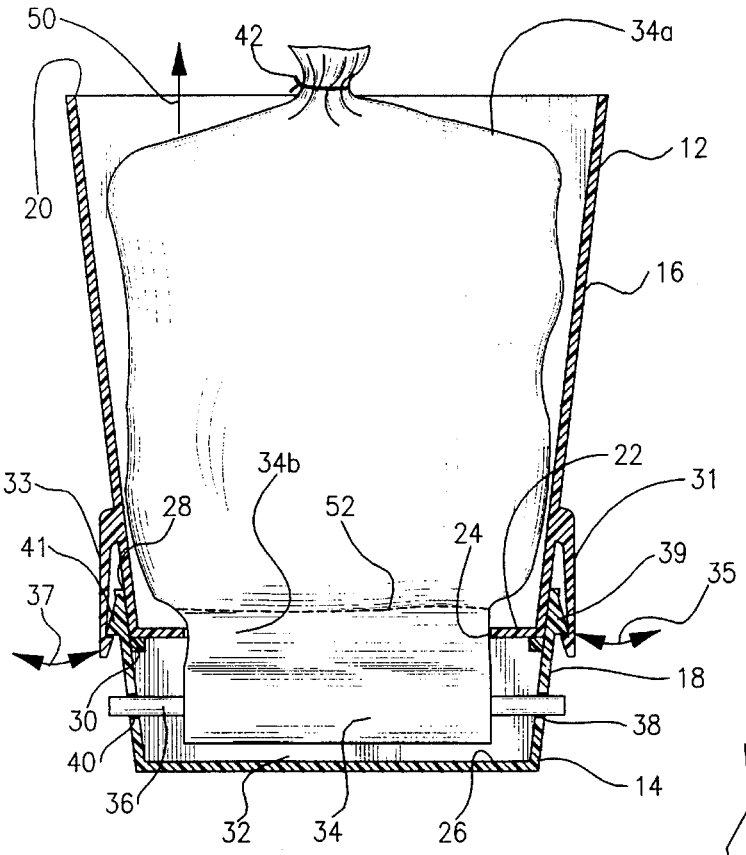
FIG. 4 is a partly cross sectional view of a trash bas being removed from the receptacle and a fresh lining bag being pulled into the receptacle from the holder.

Holder 14 includes a bottom portion 26, FIGS. 2, 3 and 4 that is unitarily connected to a lower end of peripheral wall portion 18. As illustrated in FIGS. 1, 2, and 4, holder 14 has an open upper end that, unlike the prior art, receives the lower end of receptacle 12.

As best shown in FIG. 4, peripheral wall portion 18 of holder 14 and side wall portion 14 of receptacle 12 taper inwardly toward the lower ends of the respective components. In other words, the open upper ends of the receptacle and the holder are wider than the lower ends. As a result, side wall portion 16 interengages the inside surface of peripheral wall 18 and supports the receptacle within the holder such that receptacle floor 22 is spaced above holder bottom portion 26. Additionally, a peripheral lip 30, FIGS. 2, 3 and 4, carried by the inside surface of the holder's peripheral wall portion 18 interengages the holder and receptacle 12. This lip may be composed of a resilient rubber or synthetic gasket that is secured to holder 14 by an appropriate adhesive or in an appropriate groove or channel. In preferred embodiments, the lip is molded permanently into the holder. Lip 30 supports the lower surface of receptacle floor 22 and helps to support the receptacle above the bottom surface 26 of holder 14. The lip provides such support even if the side wall portion 16 and the peripheral wall portion 18 are not tapered inwardly and do not directly interengage. In alternative embodiments, the peripheral lip may be attached directly to the bottom surface of receptacle floor 22 or the outside peripheral surface of side wall portion 16.

As shown in FIGS. 1 and 3, receptacle 12 carries a pair of latch elements 31 and 33 that are connected unitarily or otherwise to opposing side walls of receptacle 12. Latches 31 and 33 are flexible as indicated by double headed arrows 35 and 37 in FIG. 4. The latch elements are biased inwardly toward the side walls of the receptacle. Holder 14 carries a complementary pair of catches 39 and 41 that are molded or otherwise formed permanently in the corresponding opposing peripheral walls of holder 14 engaged by the side walls carrying latch elements 31 and 33. Receptacle 12 and holder 14 are locked together by flexing, latch elements 31 and 33 apart from their respective side walls and inserting receptacle 12 into the open upper end of holder 14. The latches 31 and 33 are then released such that they engage and lock with complementary catches 39 and 41 on holder 14. This interlocks the receptacle and the holder.

Receptacle 12 is supported within holder 14 in the above manner such that an interior bag accommodating chamber 32 is defined in holder 14. A conventional roll 34 of perforated plastic trash lining bags is mounted within chamber 32 on a rotatable spindle 36. As used herein, "perforated bags" refers to a conventional roll of plastic bags that are connected end to end along transverse perforations. In the embodiment shown in FIGS. 1–4, spindle 36 is rotatably mounted through side openings 38 and 40 formed in opposing peripheral walls of holder 14. The spindle may be constructed of any suitable material such as wood or plastic. As best shown in FIG. 3, O-ring washers 45 and 47 are mounted to the spindle outside of holder 14. These hold the spindle in place and prevent it from moving longitudinally in the openings 38 and 40. A leading end 42 of plastic bag roll 34 extends from the roll, through slot 24 in receptacle floor 22, and out through open upper end 20 of receptacle 12.

To install a fresh roll of bass 34, the latches 31 and 33 are disengaged from their respective catches 39 and 41 and the receptacle 12 is removed from holder 14. If an empty spindle 36 is located in the holder, that spindle is removed by first removing one of the washers 45 and 47 and then pulling the empty spindle longitudinally out of the holder. A fresh roll of bags 34 is then mounted on spindle 36 and the spindle is re-engaged with the holder openings 38 and 40. The previously removed washer is re-attached and the receptacle 12 is re-engaged with holder 14 by inserting the lower end of the receptacle into opening 28 of holder 14. The leading end 42 of roll 34 is pulled upwardly through slot 24 in receptacle 12 until a leading bag **34*a* is positioned in the receptacle, as shown in FIGS. 1 and 2. A leading circumferential portion 44 of bag 34*a* overlaps the open upper end 20 of receptacle 12 and holds bag 34*a* in place and in position to line receptacle 12. Trash and other debris are then deposited into bag 34*a*** in a conventional manner.

When the leading bag **34*a* is full, it is removed and disposed of in the manner shown in FIG. 4. The leading end 42 of the bag is closed and may be secured in this condition by an appropriate bag tie. The bag is then lifted from receptacle 12 in the direction of arrow 50. As bag 34*a* is pulled upwardly, a following or trailing bag 34*b* is pulled from roll 34 through slot 24 and into receptacle 12. When the bottom of bag 34*a*, represented by perforation 52, reaches the upper open end 20 of receptacle 12, the uppermost bag 34*a* is separated from second bag 34*b* by tearing along perforation 52. The full trash bag 34*a* is then disposed of in a conventional manner. The second bag 34*b* is now positioned in receptacle 12 and is engaged with the receptacle in a manner identical to that shown for leading bag 34*a* in FIG. 1. Specifically, the leading circumferential portion of second bag 34*b* is wrapped around the upper open end 20 of receptacle 12** and is held in place to line the receptacle and receive trash.

The above process is continued until all the bags on roll 34 are depleted. Then, the receptacle 12 is unlocked from holder 14 by pulling latches 31 and 33 outwardly and disengaging them from catches 39 and 41, respectively. The receptacle is lifted out of the holder and a fresh roll of bags 34 is added to the holder in the manner described above.

Figure 5:
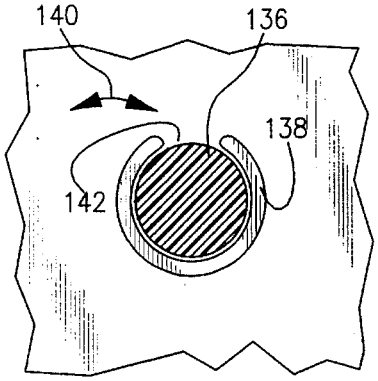
FIG. 5 is an elevational, cross sectional view illustrating an alternative snap lock bearing for mounting the spindle in the holder.

FIG. 5 shows an alternative spindle 136 that is mounted in a preferred snap lock bearing 138. A pair of such bearings are provided on opposing walls of the holder. Bearing 138 is composed of a resilient plastic and may be unitarily molded with the holder. The bearing is resiliently flexible, as indicated by double headed arrow 140, so that the mouth 142 of the bearing may be selectively expanded. Spindle 136 is introduced into bearing 138 by pushing the end of the spindle in through opening 142. The bearing flexes open in the direction indicated by double-headed arrow 140 to admit the end of the spindle through widened mouth 142. After the spindle is admitted into the bearing, the opening 142 closes to lock the spindle in place. Subsequently, the spindle is removed from bearing 138 by urging it out through mouth 142. Again, the bearing is resiliently flexible such that mouth 142 temporarily widens under the urging of spindle 136 to permit the spindle to be removed.

Figure 6:
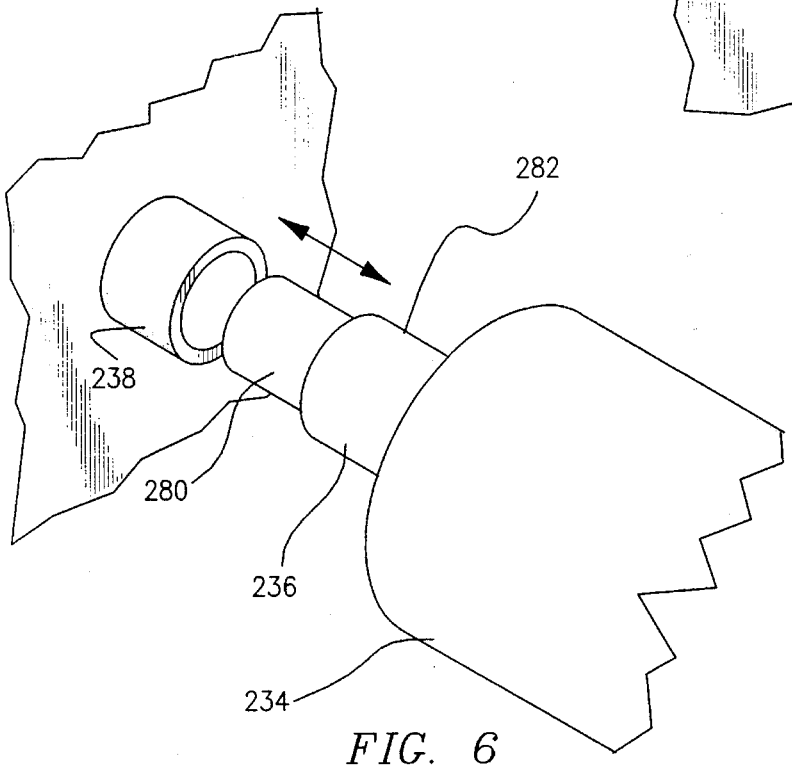
FIG. 6 is a perspective view of another alternative bearing, for mounting a collapsible spindle in the holder.

A further alternative technique for mounting the spindle in the holder is illustrated in FIG. 6. Therein, a collapsible, telescoping spindle 236 is utilized. A bearing 238 is mounted in the side wall of the holder. A complementary bearing is formed in an opposing wall of the holder for holding the opposite end of the spindle. This structure resembles a conventional telescoping spindle used to mount a roll of toilet paper in a holder. Longitudinal components 280 and 282 are resiliently collapsed to introduce spindle 236 into and remove spindle 236 from bearing 238. As a result, roll 234 carried by spindle 236 can be replaced when necessary.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A system for automatically lining a trash receptacle, which system comprises:

a trash receptacle including a side wall portion, an open upper end and a floor portion interconnected to said side wall portion at a lower end of said receptacle, said floor portion having a slot formed therein;

a separate holder including a generally vertically disposed peripheral wall portion that surrounds an interior space, a generally horizontal and planar bottom portion that extends completely across a lower end of said holder and is interconnected unitarily to said peripheral wall portion such that access into said interior space through said lower end of said holder is blocked, and an opening formed in an upper end of said holder, which opening communicates with said interior space and receives said lower end of said receptacle;

means for interengaging said receptacle and said holder such that said floor portion of said receptacle is spaced above said bottom portion of said holder to define a bag accommodating chamber in said holder; said means for interengaging including a lip portion that is carried by an inside surface said peripheral wall portion intermediate said upper and lower ends of said holder said lip portion interengaging said floor portion of said receptacle when said receptacle is received in said holder to support said receptacle such that said floor portion of said receptacle is spaced about said bottom portion of said holder spindle means for carrying a roll of perforated plastic trash bags; and means for rotatably mounting said spindle means to said holder such that said spindle means extend across said holder chamber, said trash bags being pulled sequentially from said roll through said slot and into said receptacle, whereby each said bag is temporarily positioned to line said receptacle and then removed from said receptacle to pull a following bag from said roll into said receptacle.

2. The system of claim 1 in which said receptacle and said holder are each formed of a unitary construction.

3. The system of claim 1 in which said side wall portion includes four interconnected side walls and said peripheral wall portion includes four complementary interconnected peripheral walls.

4. The system of claim 1 in which said peripheral wall portion defines said opening of said holder.

5. The system of claim 1 in which said peripheral wall portion of said holder includes a tapered inner surface for interengaging said side wall portion of said receptacle.

6. The system of claim 1 in which said means for rotatably mounting include a pair of aligned openings formed in said peripheral wall portion for rotatably receiving said spindle means.

7. The system of claim 1 further including releasable latch means for selectively interlocking said receptacle and said holder.

8. The system of claim 1 in which said means for rotatably mounting include a pair of aligned snap lock bearings attached to said peripheral wall portion for rotatably receiving said spindle means.

9. A system for automatically lining a trash receptacle, which system comprises:

a trash receptacle including a side wall portion, an open upper end and a floor portion interconnected to said side wall portion at a lower end of said receptacle, said floor portion having a slot formed therein;

a separate holder including a generally vertically disclosed peripheral wall portion that surrounds an interior space, a generally horizontal and planar bottom portion that extends completely across a lower end of said holder and is interconnected unitarily to said peripheral wall portion such that access into said interior space through said lower end of said holder is blocked, and an opening formed in an upper end of said holder, said opening communicates with said interior space and receives said lower end of said receptacle;

means for interengaging said receptacle and said holder such that said floor portion of said receptacle is spaced above said bottom portion of said holder to define a bag accommodating chamber in said holder;

spindle means for carrying a role of perforated plastic trash bass; and means for rotatably mounting said spindle means to said holder such that said spindle means extend across said holder chamber, said trash bass being pulled sequentially from said roll through said slot and into said receptacle, whereby each said bag, is temporarily positioned to line said receptacle and then removed from said receptacle to pull a following bag from said roll into said receptacle.

10. The system of claim 9 in which said means for interengaging include a lip element that is disposed between said receptacle and said holder when said receptacle is received in said opening of said holder.

11. The system of claim 10 in which said lip element is a resilient gasket.

12. The system of claim 10 in which said lip is attached to said peripheral wall portion of said holder.

13. The system of claim 12 in which said peripheral wall portion includes an inner surface that carries said lip element.

* * * * *

UNITED STATES PATENT AND TRADEMARK OFFICE

CERTIFICATE OF CORRECTION

PATENT NO. : 5,503,292

DATED : April 2, 1996

INVENTOR(S) : Charles Cucchiara

It is certified that error appears in the above-identified patent and that said Letters Patent is hereby corrected as shown below:

On title page, items [19] and [76], "Cuccharia" should read --Cucchiara--

Signed and Sealed this

Twenty-third Day of July, 1996

*Attest:*

Bruce Lehman

BRUCE LEHMAN

*Attesting Officer*

*Commissioner of Patents and Trademarks*